US006047691A

United States Patent [19]

Ketterer

[11] Patent Number: 6,047,691

[45] Date of Patent: Apr. 11, 2000

[54] IGNITION SYSTEM

[75] Inventor: Markus Ketterer, Stuttgart, Germany

[73] Assignee: Robert Bosch GmbH, Stuttgart, Germany

[21] Appl. No.: 09/002,437

[22] Filed: Jan. 2, 1998

[30] Foreign Application Priority Data

Jan. 4, 1997 [DE] Germany ..... 197 00 179

[51] Int. Cl.[7] ..... F02P 3/04

[52] U.S. Cl. ..... 123/634; 123/644

[58] Field of Search ..... 123/598, 606, 123/630, 634, 644, 651; 315/209 T

[56] References Cited

U.S. PATENT DOCUMENTS

| | | | |
|---|---|---|---|
| 4,589,398 | 5/1986 | Pate et al. | 123/596 |
| 4,677,960 | 7/1987 | Ward | 123/598 |
| 4,868,730 | 9/1989 | Ward | 123/596 X |
| 5,131,376 | 7/1992 | Ward et al. | 123/598 |
| 5,315,982 | 5/1994 | Ward et al. | 123/598 X |
| 5,343,844 | 9/1994 | Fukui et al. | 123/630 X |
| 5,456,241 | 10/1995 | Ward | 123/598 |
| 5,506,478 | 4/1996 | Daetz | 315/209 T |

FOREIGN PATENT DOCUMENTS 44 09 985 A1 9/1995 Germany .

*Primary Examiner*—Tony M. Argenbright
*Attorney, Agent, or Firm*—Kenyon & Kenyon

[57] ABSTRACT

A resonance transducer ignition system for an engine includes a voltage source, a semiconductor circuit-breaker, a resonance capacitance, an energy recovery diode, an open- and closed-loop control unit, a spark plug and an ignition transformer. The resonance capacitance is part of a first resonant circuit. A second resonant circuit is composed of a secondary capacitance. The secondary capacitance is composed of a spark plug capacitance and a stray capacitance. The two resonant circuits are coupled to one another via the ignition transformer, the coupling coefficient, k, being >0.65.

11 Claims, 5 Drawing Sheets

IGNITION SYSTEM

FIELD OF THE INVENTION

The present invention relates to an ignition system for an engine. The ignition system is set up as a resonance transducer and comprises a voltage source, a semiconductor circuit-breaker, a resonance capacitance, an energy recovery diode, an open- and closed-loop control unit, a spark plug and an ignition transformer. The resonance capacitance is part of a first resonant circuit. A second resonant circuit is composed of a secondary capacitance. The secondary capacitance is composed of a spark plug capacitance, a stray capacitance and of a winding capacitance of the ignition transformer.

BACKGROUND INFORMATION

Ignition systems that work in accordance with the principle of a resonance transducer are described, for example, in German Patent No. 44 09 985 A1 or European Patent No. 0 674 102 A2. They describe systems in which a suitably excited resonant circuit, comprised of the primary winding of the ignition transformer and of a capacitor connected in series thereto, ensures that an a.c. current is produced.

The advantages of an a.c. current ignition can be seen, in particular, in that various spark currents are attainable, and that the spark duration is only limited by the maximum output of the power supply unit. These advantages are derived from the fact that in an a.c. current ignition, the energy is continuously transferred to the spark. In contrast, a known inductive ignition system stores the energy in the coil. In the case of the inductive system, the energy must first be determined as accurately as possible to achieve an adequate voltage supply. However, in conventional inductive ignition systems, as soon as this energy packet is "sent off", the spark energy is fixed and can only be influenced through additional measures.

Generally, known ignition systems, whether they work capacitively or inductively, are engineered for the maximum requirements of the engine. This means that an ignition system of this kind works with the same ignition parameters in all operating points of the engine. The result in such an ignition system that is not adaptable can be unnecessary spark plug wear.

Present-day engines work under widely varying operating conditions, for example, due to the influence of the exhaust-gas recirculation. The need therefore exists for an ignition system which can adapt to various operating conditions.

SUMMARY OF THE INVENTION

The ignition system of the present invention has advantages over the background art with respect to attainable efficiency, smaller installation dimensions, and more cost-effective manufacturing. Because the ignition transformer has a higher inductive coupling coefficient of >0.65, it is possible to reduce the inductance of primary winding $L_1$ and of secondary winding $L_2$. The weight and the dimensions of the transformer are reduced to the same extent, so that it requires less installation space. Because the primary current required in the case of the comparable, related-art spark current is less, the ignition transformer is more efficient with respect to energy transfer, because fewer losses arise in the coil and in the surrounding engine block.

The smaller installation dimensions, in conjunction with the efficient coupling coefficient, also lead to the advantage that the ignition transformers fit in very small spark plug shafts, with no significant change in the characteristic values of the ignition transformer upon installation.

Due to a smaller interrupting current than in known ignition systems and the better phase effect of the secondary voltage because of the increased coupling coefficient, a smaller collector voltage builds up at the resonance capacitance, which constitutes a further advantage, since less expensive components can be used.

When smaller inductances are used, the further advantage is attained that the ignition system is much better suited for an ionic current measurement. In this known measuring method, the residual energy stored in the ignition transformer after the spark ends must dissipate first, so as not to corrupt the measuring result. Due to the fact that the inductance values are less than in related-art ignition systems, little energy is stored in the ignition transformer during the sparking phase of the ignition spark, so that there is no problem of residual energy after sparking ends.

DETAILED DESCRIPTION

Figure 1A:
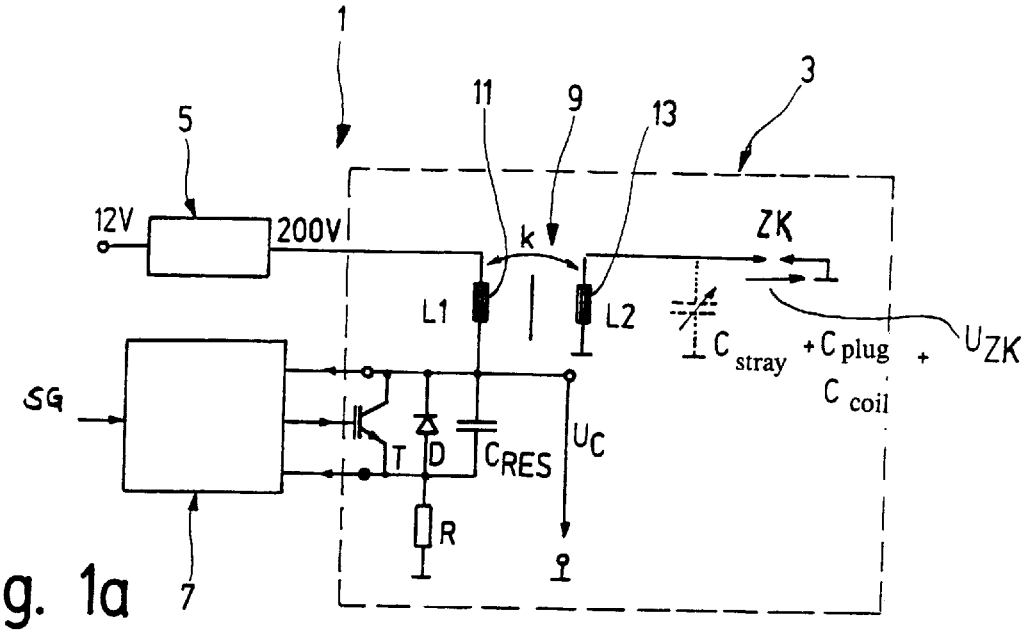
FIG. 1*a* illustrates an embodiment of an ignition system according to the present invention.

FIG. 1*a* depicts an ignition system 1 including an ignition circuit 3 shown in dotted lines, a voltage supply unit 5, and an open- and closed-loop control unit 7. Ignition circuit 3 has an ignition transformer 9 including a primary winding 11 and a secondary winding 13. One connecting terminal of primary winding 11 is connected to voltage-supply unit 5, the other connecting terminal to a collector of an ignition transistor T. An emitter terminal of transistor T is connected via a resistor R to ground. Arranged parallel to the collector and emitter terminal is a diode D and a capacitor $C_{res}$. In this context, the cathode of diode D is connected to the collector of transistor T.

It turns out that it is particularly advantageous to design transistor T as an IGB (insulated-gate bipolar) transistor. The control input (base) of transistor T receives a control pulse from open- and closed-loop control unit 7.

On the secondary side, spark plug ZK is connected in series to secondary winding 13 of the ignition transformer, the two connecting terminals of the secondary winding and of the spark plug that are not connected to one another being connected to ground. As necessitated by technical requirements, present in this circuit is a stray capacitance $C_{stray}$, a spark plug capacitance $C_{plug}$, as well as a coil capacitance $C_{coil}$ shown as a capacitor with dotted lines.

Voltage-supply unit 5 converts the 6–14 V voltage usually present in a vehicle into a d.c. voltage of about 100 V to 200 V, which is then applied to the primary winding. Consideration should be given to the fact that the level of this d.c. voltage is not without significance for the operating frequencies and spark currents that adjust themselves. Thus, frequencies of over 40 kHz can be reached during the normal spark duration. However, if the maximum voltage supply is required, then the frequencies are correspondingly lower.

A control device SG feeds open- and closed-loop control unit 7 a control signal, which preferably encodes a preselectable interrupting current $I_A$. Moreover, open- and closed-loop control unit 7 is fed other controlled variables, on the one hand namely, collector voltage $U_c$ of transistor T and, on the other hand, primary current $I_p$. A measuring signal proportional to collector voltage $U_c$ can be generated, for example, by a voltage divider, and a measuring signal conforming to the primary current, for example, by tapping off the voltage dropping across a shunt. These controlled variables are processed in accordance with a control algorithm, to be explained further on, and converted into control pulses for transistor T.

When dimensionally designing the components of ignition circuit 3, it is crucial that the coupling coefficient between the primary side and secondary side exceed a value of 0.65, and that it preferably remain below 0.9. The coupling coefficient k is an electrical property of the ignition transformer, defined only by the mechanical dimensions. It determines to what extent the magnetic fluxes of the two coils (primary and secondary side) permeate one another. The geometric dimensions of the transformer can be varied to change the magnetomotive force of the windings inside the transformer. The previously mentioned coupling coefficient of k>0.65 makes it possible for windings having low inductance values $L_1$, $L_2$ to be used. Moreover, when working with coils having a high coupling coefficient in a narrow space, there is no danger of too many lines of flux being affected by the engine block, and of the ignition transformer consequently exhibiting different coupling coefficients in different engines.

Figure 1B:
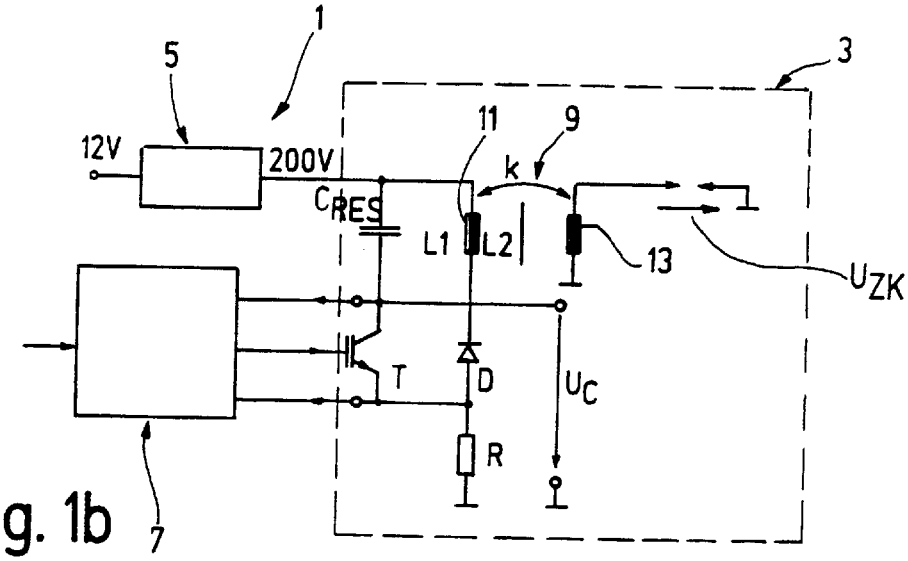
FIG. 1*b* illustrates an embodiment of an ignition system according to the present invention.

A system that is modified with respect to the described ignition system is depicted in FIG. 1*b*. The distinction lies in that capacitor $C_{res}$ is not disposed parallel to diode D, rather parallel to primary winding 11. Apart from that, the design conforms with that of the first specific embodiment, so that there is no need to describe the parts denoted with the same reference symbols. Omitted for the sake of clarity were merely capacitances $C_{stray}$, $C_{plug}$, and $C_{coil}$. However, the modified configuration of capacitor $C_{res}$ has no effect on the method of functioning of the ignition system.

Figure 1C:
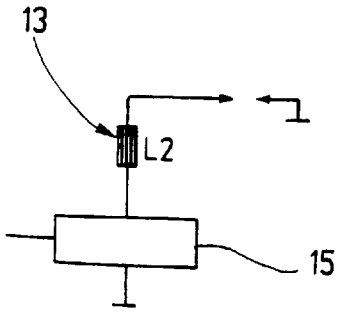
FIG. 1*c* illustrates an ionic-current measuring device, in a secondary circuit, in accordance with the embodiments shown in FIGS. 1*a* and 1*b*.

FIG. 1*c* illustrates the secondary side with secondary winding 13 of ignition transformer and of spark plug ZK. In series to secondary winding 13, provision is made for an ionic-current measuring device 15, which transmits a measuring signal, for example, to open- and closed-loop control unit 7 or to upstream control unit SG. The principle of ionic-current measurement is generally known, so that no firer description will be given here. In any case, ionic-current measuring device 15 can be optionally used without any further changes in terms of circuit engineering in the two exemplary embodiments in accordance with FIG. 1*a* and FIG. 1*b*.

Figure 2A:
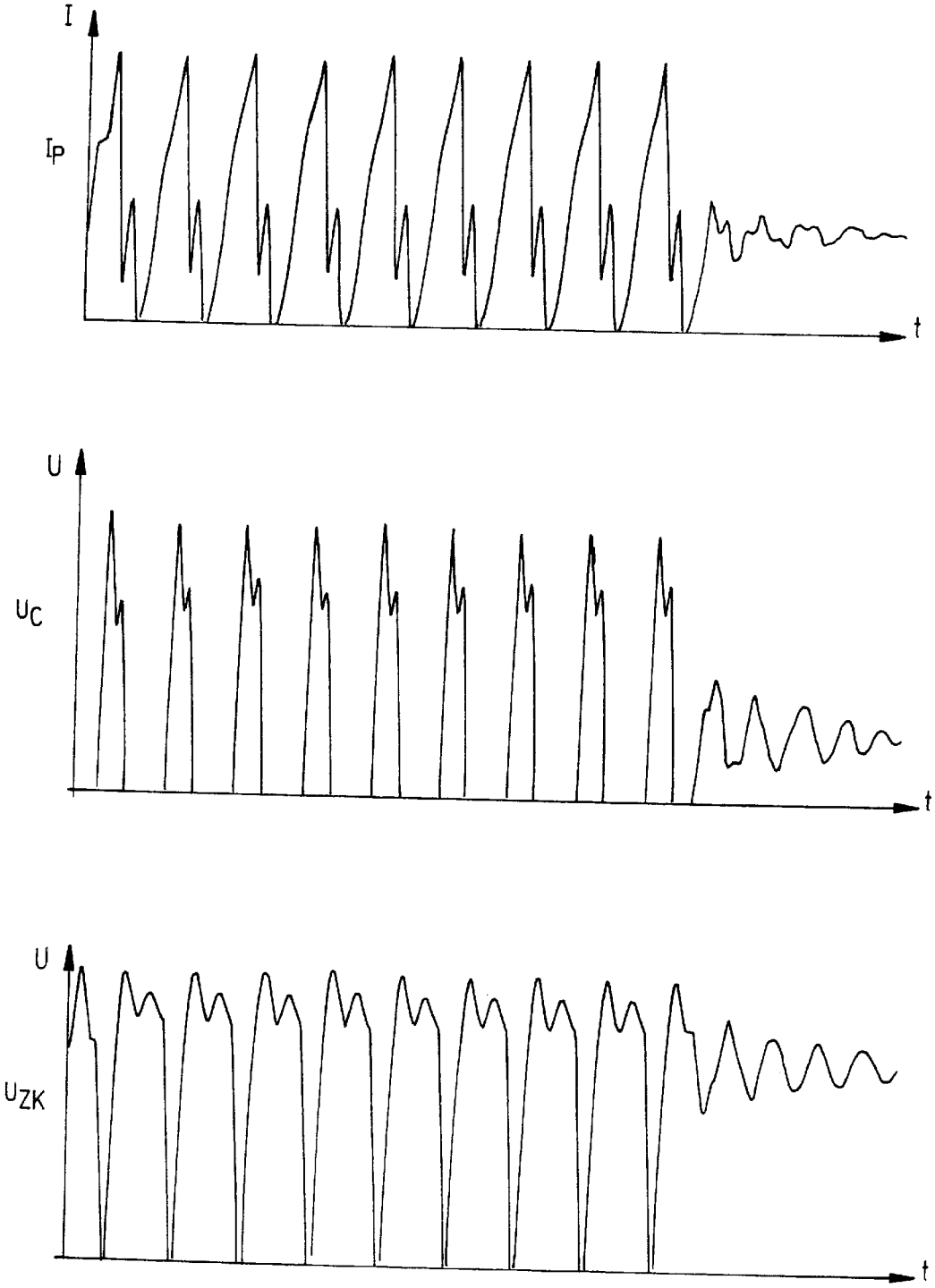
FIG. 2*a* illustrates various voltage and current diagrams for elucidating the method of functioning of the ignition system of the present invention prior to spark discharge.
Figure 2B:
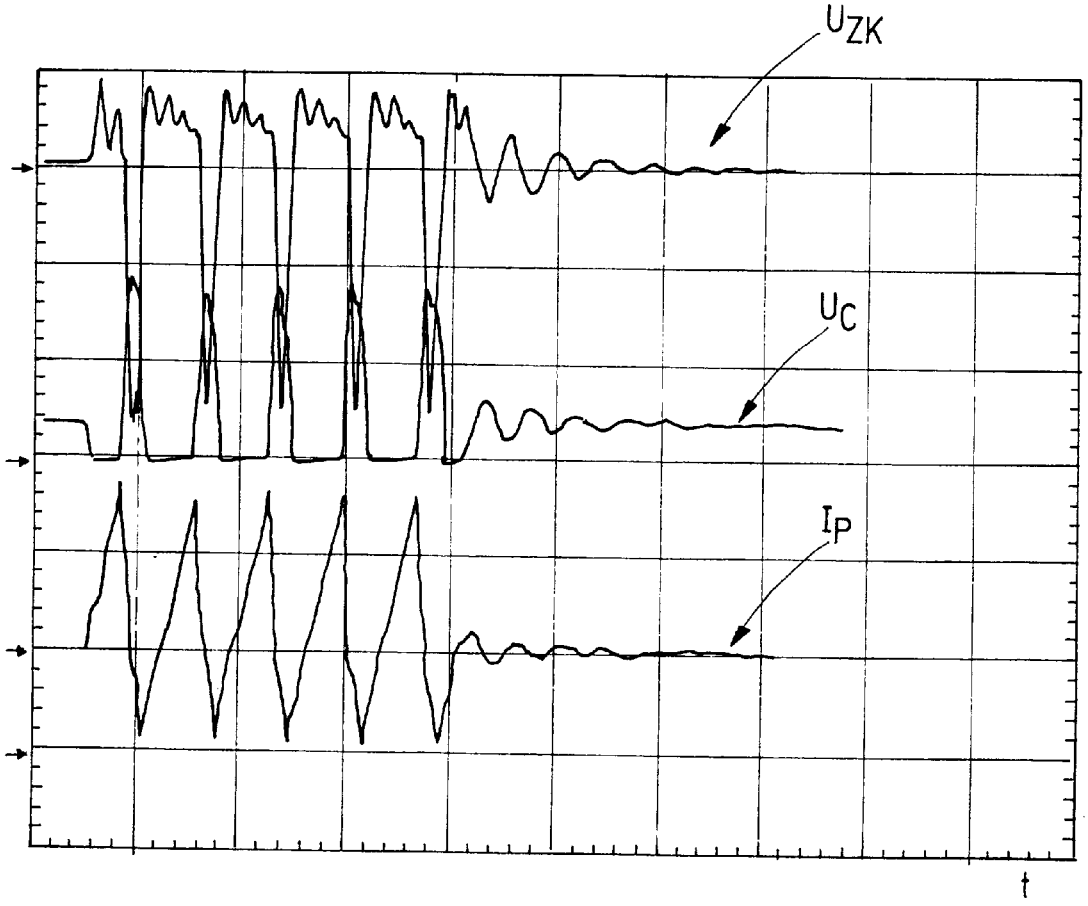
FIG. 2*b* illustrates various voltage and current diagrams for elucidating the method of functioning of the ignition system of the present invention prior to spark discharge.
Figure 3:
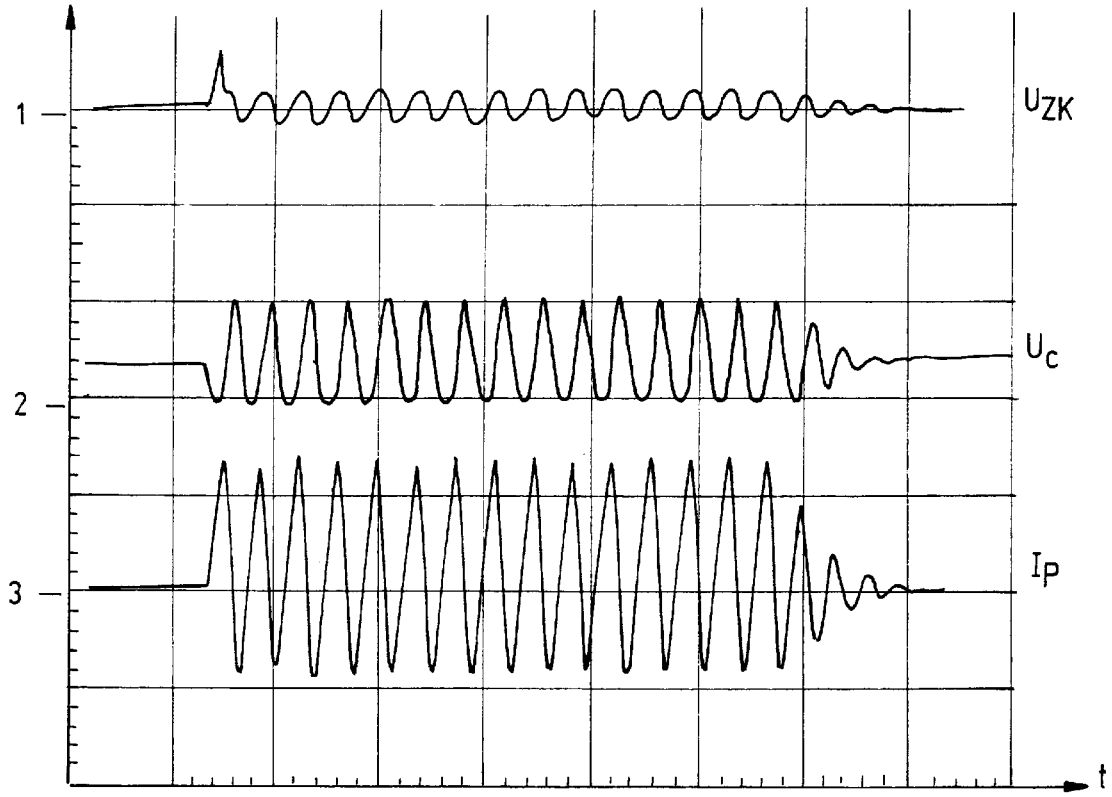
FIG. 3 is a diagram illustrating various voltage and current patterns subsequent to spark discharging.

At this point, the method of functioning of ignition system 1 and, in particular, the effects of coupling coefficient k and of low inductance values $L_1$, $L_2$ on the ignition performance characteristics are described, reference being made to FIGS. 2*a*, 2*b* and 3. The diagrams shown in FIGS. 2*a*, 2*b* and 3 each show the time characteristic of primary current $I_p$, of collector voltage $U_c$ and of secondary voltage $U_{ZK}$.

To trigger an ignition, control unit SG supplies open- and closed-loop control unit 7 with a control signal, which contains coded information about the value of interrupting current $I_A$. The open- and closed-loop control unit then releases a signal to transistor T, which is switched to the low-resistance state. As a result, a current $I_P$ begins to flow from voltage-supply unit 5 via primary winding 11, transistor T and resistor R. The value of primary current $I_P$, measured as a voltage value dropping across resistor R, is fed as a controlled variable to open- and closed-loop control unit 7. As soon as primary current $I_P$ reaches interrupting current $I_A$ predefined by the control unit, unit 7 switches transistor T into the high-resistance state again (step 1).

As soon as the collector voltage at transistor T, which is likewise supplied to the control unit as a controlled variable, falls below a specific, predefined value, and the time derivation of collector voltage $U_c$ is negative, open- and closed-loop control unit 7 switches the transistor again into the low-resistance state (step 2).

These two steps 1 and 2 are repeated with any interrupting currents which are provided in the system and which can change during the spark duration, until the control device supplies the signal for "ignition off". Transistor T remains at high resistance, and the ignition spark ceases to discharge.

What is characteristic of the ignition system of the present invention is that during the time of maximum voltage $U_{zk,max}$, there is virtually no energy in the ignition transformer, not in primary winding 11 nor in secondary winding 13. Moreover, FIGS. 2*a* and 2*b* show that voltage characteristic $U_{zk}$ is unsymmetrical, but is repeated at regular intervals. It is advantageous for the very pronounced voltage peaks $U_{zk,max}$ that are clearly perceivable in FIGS. 2*a* and 2*b* to be shown in the negative direction, which is a function of the winding direction of the ignition transformer, since less ignition voltage is required in the negative direction due to the geometry of the spark plug.

Figure 2C:
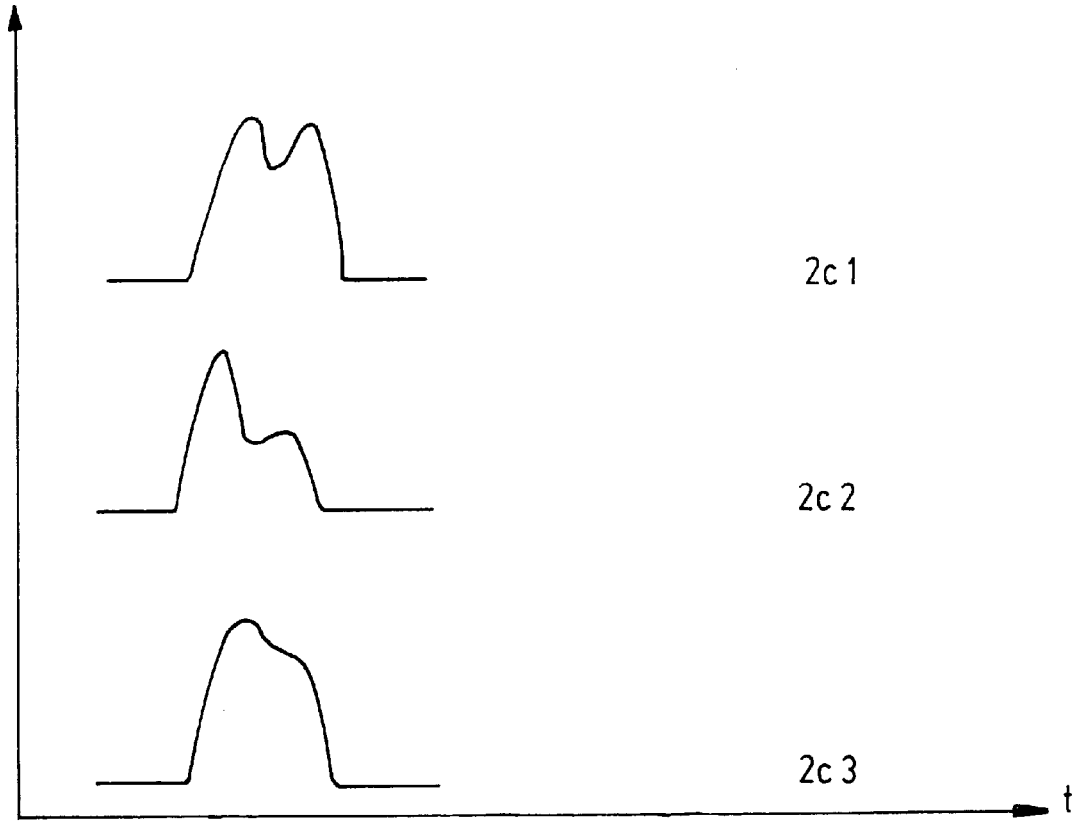
FIG. 2*c* is a timing diagram illustrating various time characteristics of the collector voltage according to an embodiment of the present invention.

FIG. 2*a* also reveals that the maxima of collector voltage $U_c$ show indentations. This can be explained by the secondary circuit's effect on the primary circuit, which is more heavily pronounced because of the high coupling coefficient k. As revealed by the various time characteristics of the collector voltage in FIG. 2*c*, the profile of collector voltage $U_c$ can be changed in the area of the maximum by varying the voltage ratio of ignition transformer 9. It should also be mentioned that the upper horizontal line shows the value of the maximum dielectric strength, and the lower line the switch-on threshold for the transistor.

FIGS. 2*a* and 2*b* reveal that approximately one secondary-side oscillation, essentially determined by resonance capacitance $C_{res}$, occurs in the high-resistance state of transistor T during one primary-side half wave. If transistor T is in the low-resistance state, however, the number of oscillations occurring on the secondary side can vary. In this case, the number of oscillations is a function of the available supply voltage and of the inductance of primary winding 11.

Care should be taken, however, to ensure that the local minimum in the harmonic wave of collector voltage $U_c$ not fall below the switch-on threshold of transistor T, since otherwise the desired voltage maximum will not be reached, as the transistor would be switched on again by the open- and closed-loop control unit. Furthermore, the maximum dielectric strength of the components must be taken into consideration. The two limits are indicated in illustration 2.c.1.

The maximum voltage supply $U_{zk,max}$ is made available periodically when transistor T 25 switched to high resistance. The voltage is salient on only one side and is a function of the magnitude of the supply voltage. The full voltage supply $U_{zk,max}$ is reached already in the first period, the spark discharging then as a rule.

Following the spark discharging, the ignition system shown in FIGS. 1*a* and 1*b* exhibits nearly the same performance characteristics as other resonance transducers known from the related art. The phase effects on collector voltage UC are no longer present, since the sparking voltage still assumes values of only about 1000 V. Because of the high coupling coefficient k, interrupting current $I_A$ can be selected to be noticeably lower. As a result, the maximally occurring collector voltage of the transistor of over 1000 V in conventional systems drops to about 750 V in the present ignition system. Thus, appreciable advantages are attained with respect to the dielectric strength of the components.

The desired sparking current $I_{Fu}$ can be calculated from the spark resistance and from the voltage ratio of the ignition transformer. It applies by approximation that $$I_{FU} = k \cdot \sqrt{L_1 / L_2} \cdot I_A$$

Thus, sparking current $I_{Fu}$ is known in advance and the desired sparking current $I_{Fu}$ can be selected by control unit SG. The corresponding signal patterns are shown in FIG. 3.

Thus, by preselecting interrupting current $I_A$, it is possible to determine sparking current $I_{Fu}$.

As soon as the spark across the gap goes out, the secondary circuit again acquires capacitive characteristics. The recharging currents of the secondary capacitance provide then for a rise in voltage supply $U_{zk}$ in accordance with the same principle as applies immediately following energizing of the ignition system. By predefining interrupting current $I_A$, it is advantageously possible to drive operating states which are known as energy-intensive, first with a higher interrupting current $I_A$ so that voltage supply $U_{zk}$ and spark current $I_{Fu}$ rise. Of course, alternatively or additionally, the spark duration is also to be increased.

At the highest possible interrupting current $I_A$, the maximum, secondary-side voltage supply $U_{zk,max}$ is also made available. Since the voltage maximum $U_{zk,max}$ is reached already in the first period, the spark will also discharge already at this instant. If a conductive plasma channel is already formed at this point, then a high spark current $I_{Fu}$ will flow due to the high interrupting current $I_A$. Immediately following the first period of primary current $I_P$, the switch can then be made by control unit SG or by open- and closed-loop control unit to a lower interrupting current $I_A$, making it possible to reduce spark plug wear.

Through the good coupling coefficient k of the ignition transformer, a good phase effect of the large secondary voltage $U_{zk,max}$ (about 30 kV) on the primary side is given. Thus, for example, a proper ignition can be detected through analysis of primary current $I_p$. The ignition is effected, namely, when the reactions on the primary side have nearly completely subsided. This is revealed by a comparison of the signal patterns of FIGS. 2*a*, 2*b* and 3.

Thus, due to its high functionality, the ignition system of the present invention guarantees performance characteristics that are adapted as a function of an operating point, so that when working with modern engine concepts, such as lean-mix engines, exhaust-gas recirculation, and direct fuel injection, acceptable spark plug service lives can be accompanied by excellent mixture ignition.

What is claimed is:

1. A resonance transducer ignition system for an engine, comprising:

an ignition transformer;

a first resonant circuit including a resonance capacitance;

a second resonant circuit including a secondary capacitance, the secondary capacitance having a spark plug capacitance, a winding capacitance of the ignition transformer and a stray capacitance;

wherein the ignition transformer includes a primary winding and a secondary winding, the ignition transformer coupling the first resonant circuit to the second resonant circuit, a spark plug being coupled to the secondary winding of the ignition transformer, a voltage source being coupled to a first terminal of the primary winding of the ignition transformer;

a semiconductor circuit-breaker coupled to a second terminal of the primary winding of the ignition transformer;

an open- and closed-loop control unit coupled to the semiconductor circuit-breaker; and an energy recovery diode coupled to the resonance capacitance and to the semiconductor circuit-breaker;

wherein an inductive coupling coefficient, k, is greater than 0.65.

2. The ignition system according to claim 1, wherein the inductive coupling coefficient is greater than 0.65 and less than 0.9.

3. The ignition system according to claim 1, wherein a signal proportional to a collector voltage of the semiconductor circuit-breaker and a signal proportional to a primary current through the primary winding of the ignition transformer are transmitted as a controlled variable to the open- and closed-loop control unit.

4. The ignition system according to claim 1, wherein an interrupting current is variable during a sparking phase, the interrupting current switching the semiconductor circuit-breaker into a high-resistance state.

5. The ignition system according to claim 4, wherein a control signal is transmitted to the open- and closed-loop control unit, the control signal including a value of the interrupting current.

6. The ignition system according to claim 1, wherein the semiconductor circuit-breaker includes an insulated-gate bipolar (IGB) transistor.

7. The ignition system according to claim 1, further comprising an ionic current measuring device coupled in series with the secondary winding of the ignition transformer.

8. The ignition system according to claim 1, wherein the open- and closed-loop control unit, via an application of a control signal, switches the semiconductor circuit-breaker into a high-resistance state when a value of a primary current equals a value of an interrupting current.

9. The ignition system according to claim 1, wherein the open- and closed-loop control unit switches the semiconductor circuit-breaker into a low-resistance state when both a collector voltage is less than a predefined value and a time derivation of the collector voltage is negative.

10. The ignition system according to claim 1, wherein a maximum voltage supply is attained by producing approximately one secondary-side harmonic wave in a high-resistance state of the semiconductor circuit-breaker during one primary-side half wave.

11. A resonance transducer alternating current ignition system, comprising:

a first resonant circuit including a resonance capacitance;

a second resonant circuit including a secondary capacitance, the secondary capacitance having a spark plug capacitance, a winding capacitance of an ignition transformer and a stray capacitance, wherein the ignition transformer includes a primary winding and a secondary winding, the ignition transformer coupling the first resonant circuit to the second resonant circuit, a spark plug being coupled to the secondary winding of the ignition transformer, a voltage source being coupled to a first terminal of the primary winding of the ignition transformer, and wherein an inductive coupling coefficient of the primary winding and the secondary winding of the ignition transformer is greater than about 0.65;

a semiconductor circuit-breaker coupled to a second terminal of the primary winding of the ignition transformer;

an open- and closed-loop control unit coupled to the semiconductor circuit-breaker; and an energy recovery diode coupled to the resonance circuit and to the semiconductor circuit-breaker.

* * * * *